US007675731B2

(12) United States Patent
Bitar

(10) Patent No.: US 7,675,731 B2
(45) Date of Patent: Mar. 9, 2010

(54) TUNABLE AND AIMABLE ARTIFICIAL LIGHTENING PRODUCING DEVICE

(76) Inventor: Peter V. Bitar, 1508 E. 7th St., Anderson, IN (US) 46012

( * ) Notice: Subject to any disclaimer, the term of this patent is extended or adjusted under 35 U.S.C. 154(b) by 38 days.

(21) Appl. No.: 12/173,522

(22) Filed: Jul. 15, 2008

(65) Prior Publication Data

US 2009/0059460 A1 Mar. 5, 2009

Related U.S. Application Data

(63) Continuation of application No. 11/171,775, filed on Jun. 30, 2005, now Pat. No. 7,400,487.

(51) Int. Cl.
*F41C 9/00* (2006.01)

(52) U.S. Cl. ..... 361/232; 42/1.08

(58) Field of Classification Search ..... 361/232; 42/1.08; 102/502

See application file for complete search history.

(56) References Cited

U.S. PATENT DOCUMENTS 4,148,321 A 4/1979 Wyss et al.
4,793,325 A 12/1988 Cadossi et al.
4,911,686 A 3/1990 Thaler
5,675,103 A 10/1997 Herr
5,908,444 A 6/1999 Azure
5,952,600 A * 9/1999 Herr ..... 89/1.11
7,336,473 B2 * 2/2008 Gross ..... 361/232
7,474,518 B2 * 1/2009 Rutz et al. ..... 361/232

* cited by examiner

*Primary Examiner*—Danny Nguyen
(74) *Attorney, Agent, or Firm*—Woodard, Emhardt, Moriarty, McNett & Henry LLP

(57) ABSTRACT

A tunable and aimable artificial lightning producing device for tetanizing human voluntary muscle, disabling vehicular electronic ignition systems, and for pre-detonating wired explosives. A spark gap shaping apparatus controls a spark generated by a Tesla coil. A first stage directionalizer warps a normally spherical plasma field from the Tesla coil into an oval plasma field for confining the spark to within that shape. A second stage directionalizer converges multiple beams to successive points just ahead of a plasma field created by the first stage directionalizer without ionizing the beams, thereby maintaining ionization of a path of the spark. The spark is progressively arced to these points, thereby maintaining the path of the spark.

22 Claims, 4 Drawing Sheets

TUNABLE AND AIMABLE ARTIFICIAL LIGHTENING PRODUCING DEVICE

This application is a continuation of application No. 11/171,775, filed Jun. 30, 2005 now U.S. Pat. No. 7,400,487.

BACKGROUND OF THE INVENTION

1. Field of the Invention

The present invention relates to a lightening producing device, and more particularly, the present invention relates to a tunable and aimable artificial lightening producing device.

2. Description of the Prior Art

Numerous innovations for signal generating devices have been provided in the prior art that will be described. Even though these innovations may be suitable for the specific individual purposes to which they address, however, they differ from the present invention in that they do not teach a tunable and aimable artificial lightening producing device.

A FIRST EXAMPLE, U.S. Pat. No. 4,148,321 to Wyss et al. teaches an apparatus and method for the treatment and active massage of muscles, the apparatus comprising a generator arrangement providing a modulated alternating current with a medium-frequency carrier having a frequency comprised between 3000 Hz and 100,000 Hz, and an adjustable low modulating frequency of a fraction of 1 Hz, preferably both the carrier and the modulating currents being sinusoidal. Directly or after optional conversion to a polyphase current, a variable modulated current is supplied to electrodes placed about a body portion, e.g. a limb, whereby the current is made to flow transversally through the muscles, producing painless rhythmic muscular contractions.

A SECOND EXAMPLE, U.S. Pat. No. 4,793,325 to Cadossi et al. teaches a method for treating living tissues and/or cells consisting essentially of electromagnetically inducing in the tissues and/or cells alternating pulsating electrical signals having a wave form which comprises a positive portion with a duration of between 1 and 3 milliseconds, and a negative portion having a peak value less than that of the positive portion, followed by a region of exponential extension tending to the reference value zero.

A THIRD EXAMPLE, U.S. Pat. No. 4,911,686 to Thaler teaches a device for therapeutic treatment of cells and tissues in a living body by non-invasively applying a developed field of pulsating electrical energy to a body site to stimulate repair or growth of bone structure at the body le site containing electronic counters to control the desired number of pulses, the pulse repetition rate and the pulse duty cycle. A sensor may be used to detect the occurrence of an applied pulse and produce a signal to control the developed field and may also be used to feed a circuit which tests the developed field to determine if it is adequate for the intended purpose. As an added feature, a circuit is provided to recover a portion of the energy in the developed field, during its decline, to reduce power consumption and dissipation.

A FOURTH EXAMPLE, U.S. Pat. No. 5,675,103 to Herr teaches a non-lethal weapon for temporarily immobilizing a target subject by means of muscular tetanization in which the tetanization is produced by conducting a precisely-modulated electrical current through the target. Because the electrical current is a close replication of the physiological neuroelectric impulses which control striated muscle tissue, it tetanizes the subject's skeletal muscles without causing any perceptible sensation. The transmission of this current to the distant target is via two channels of electrically conductive air. The conductive channels are created by multi-photon and collisional ionization within the paths of two beams of coherent (laser) or columnated incoherent ultraviolet radiation directed to the target. A single beam may be used to tetanize a grounded target. The high-voltage tetanizing current flows from electrodes at the origin of the beams along the channels of free electrons within them.

A FIFTH EXAMPLE, U.S. Pat. No. 5,908,444 to Azure teaches a pulsing electromagnetic field that is generated by a tuned Tesla coil, and a plurality of pulsed signals having selected frequencies synchronously with the pulsing magnetic field. A patient is placed proximate to the Tesla coil to receive the pulsing electromagnetic field and the pulsed signals. A second pulsing magnetic field is generated to be applied to a selected portion of the patient. Methods for treating patients afflicted with a variety of conditions is also disclosed.

It is apparent that numerous innovations for signal generating devices have been provided in the prior art that are adapted to be used. Furthermore, even though these innovations may be suitable for the specific individual purposes to which they address, however, they would not be suitable for the purposes of the present invention as heretofore described, namely, a tunable and aimable artificial lightening producing device.

SUMMARY OF THE INVENTION

ACCORDINGLY, AN OBJECT of the present invention is to provide a tunable and aimable artificial lightening producing device that avoids the disadvantages of the prior art.

ANOTHER OBJECT of the present invention is to provide a tunable and aimable artificial lightening producing device that is simple to use.

BRIEFLY STATED, STILL ANOTHER OBJECT of the present invention is to provide a tunable and aimable artificial lightning producing device for tetanizing human voluntary muscle, disabling vehicular electronic ignition systems, and for pre-detonating wired explosives. A spark gap shaping apparatus controls a spark generated by a Tesla coil. A first stage directionalizer warps a normally spherical plasma field from the Tesla coil into an oval plasma field for confining the spark to within that shape. A second stage directionalizer converges multiple beams to successive points just ahead of a plasma field created by the first stage directionalizer without ionizing the beams, thereby maintaining ionization of a path of the spark. The spark is progressively arced to these points, thereby maintaining the path of the spark.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
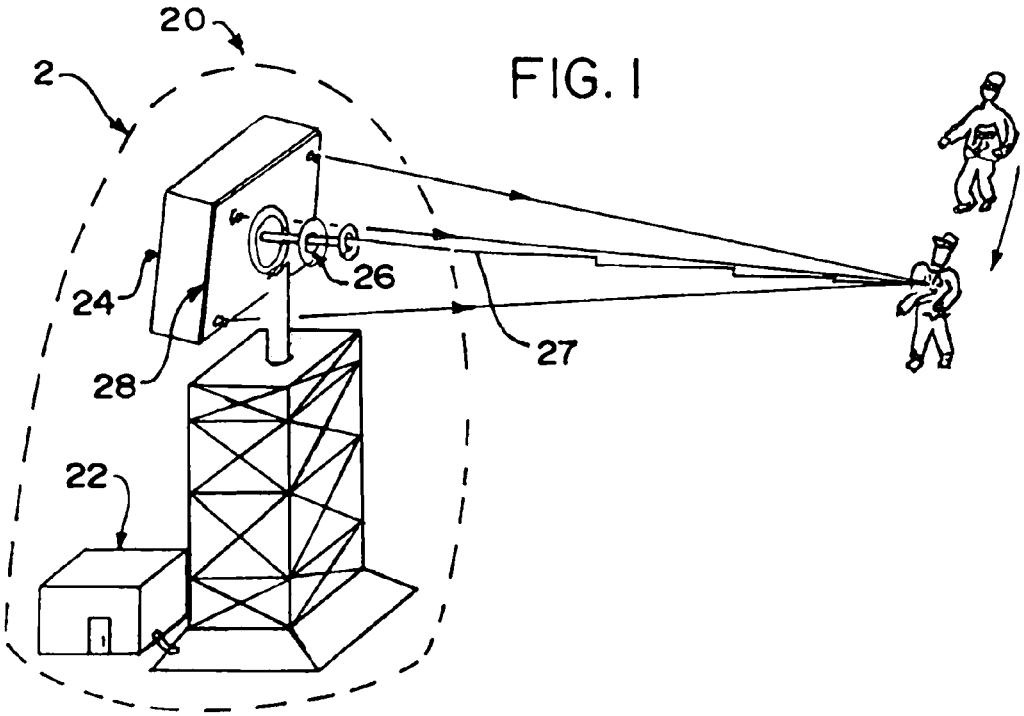
FIG. 1 a diagrammatic perspective view of the tunable and aimable artificial lightening producing device of the present invention in use.

20 tunable and aimable artificial lightening producing device of present invention

22 spark gap shaping apparatus

24 Tesla coil

25 output of Tesla coil 24

26 first stage directionalizer

27 output of first stage directionalizer 26

28 second stage directionalizer

29 converging point of second stage directionalizer 28

30 stationary spark gap assembly of spark gap shaping apparatus 22

31 second converging point of second stage directionalizer 28

32 rotational conductor of spark gap shaping apparatus 22

33 third converging point of second stage directionalizer 28

34 pair of electrodes of stationary spark gap assembly 30 of spark gap shaping apparatus 22

35 gap between pair of electrodes 34 of stationary spark gap assembly 30 of spark gap shaping apparatus 22

36 surface

38 spark

40 wheel of rotational conductor 32 of spark gap shaping apparatus 22

42 motor of rotational conductor 32 of spark gap shaping apparatus 22

44 pulley and belt system of rotational conductor 32 of spark gap shaping apparatus 22

46 plurality of pegs of wheel 40 of rotational conductor 32 of spark gap shaping apparatus 22

48 shaft of first stage directionalizer 26

50 emitter spike of shaft 48 of first stage directionalizer 26

51 output of emitter spike 50 of shaft 48 of first stage directionalizer 26

52 at least one wire mesh cage of first stage directionalizer 26

54 plurality of torus-shaped discs of first stage directionalizer 26

55 hollow centers of torus-shaped disk 54

56 large proximal torus-shaped disc of plurality of torus-shaped discs 54 of first stage directionalizer 26

58 small distal torus-shaped disc of plurality of torus-shaped discs 54 of first stage directionalizer 26

60 warped oval-shaped plasma field of first stage directionalizer 26

First Embodiment

128 second stage directionalizer

162 plurality of lasers of second stage directionalizer 128

164 controller of second stage directionalizer 128

166 beams generated by plurality of lasers 162 of second stage directionalizer 128

Second Embodiment

228 second stage directionalizer

262 plurality of lasers of second stage directionalizer 228

263 plurality of prisms of second stage directionalizer 228

264 controller of second stage directionalizer 228

266 beams generated by plurality of lasers 262 of second stage directionalizer 228

Third Embodiment

328 second stage directionalizer

362 plurality of lasers of second stage directionalizer 328

363 plurality of mirrors of second stage directionalizer 328

364 controller of second stage directionalizer 328

366 beams generated by plurality of lasers 362 of second stage directionalizer 328

Fourth Embodiment

428 second stage directionalizer

462 plurality of lasers of second stage directionalizer 428

464 open-ended tube of second stage directionalizer 428

466 fixed concave lens of second stage directionalizer 428

468 movable convex lens of second stage directionalizer 428

469 focal lens of second stage directionalizer 428

470 beaming end of open-ended tube 464 of second stage directionalizer 428

472 beams of plurality of lasers 462 of second stage directionalizer 428

474 controller of second stage directionalizer 428

DETAILED DESCRIPTION OF THE PREFERRED EMBODIMENT

Figure 2:
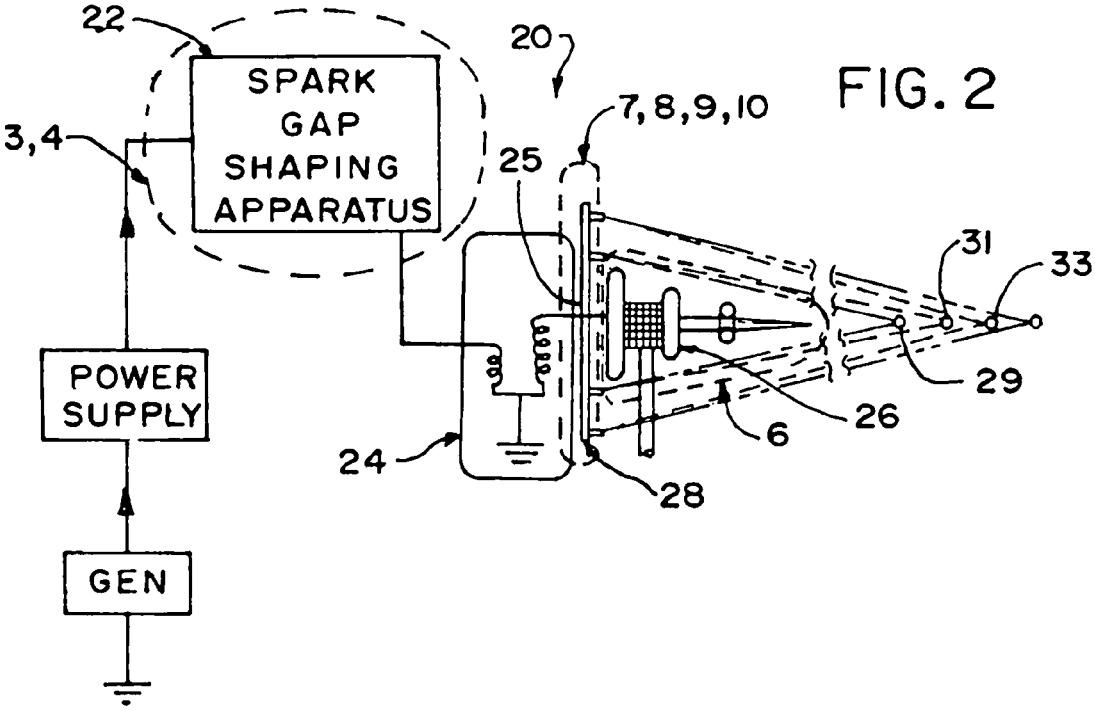
FIG. 2 is a block diagram of the area generally enclosed by the dotted curve identified by ARROW 2 in FIG. 1 of the tunable and aimable artificial lightening producing device of the present invention.

Referring now to the figures, in which like numerals indicate like parts, and particularly to FIGS. 1 and 2, which are, respectively, a diagrammatic perspective view of the tunable and aimable artificial lightening producing device of the present invention in use, and, a block diagram of the area generally enclosed by the dotted curve identified by ARROW 2 in FIG. 1 of the tunable and aimable artificial lightening producing device of the present invention. The tunable and aimable artificial lightening producing device of the present invention is shown generally at 20.

The tunable and aimable artificial lightening producing device 20 does the following:

1. Creates bolts of artificial lightning;

2. Tunes those bolts of lightning to frequencies that can tetanize human voluntary muscle, disable vehicular electronic ignition systems, and pre-detonate wired explosives;

3. Is able to aim and then direct those bolts of lightning toward a target; and

4. Is able to reach great potential distances through the extension of the artificial lightning.

The tunable and aimable artificial lightening producing device 20 comprises a spark gap shaping apparatus 22, a Tesla coil 24 having an output 25, a first stage directionalizer 26 having an output 27, and a second stage directionalizer 28.

The Tesla coil 24—called a "resonance transformers"—has an ability to create artificial lightning, but this is a crude and un-tuned, non-directional energy that has random effects and is primarily used for show.

The Tesla coil 24 comprises two inductive-capacitive (LC) oscillators—a primary and a secondary—being loosely coupled to one another. Each LC oscillator has two main components being an inductor—which has inductance L measured in Henrys—and a capacitor—with capacitance C measured in Farads.

The inductor of each LC oscillator converts an electrical current represented by the symbol I and measured in Amperes into a magnetic field, represented by the symbol B and measured in Tesla or a magnetic field into a current. The inductor of each LC oscillator is formed from electrical conductors wound into coils.

The capacitor of each LC oscillator comprises two or more conductors separated by an insulator. The capacitor of each LC oscillator converts current into an electric field represented by the symbol V and measured in Volts or an electric field into current. Both magnetic fields and electric fields are forms of stored energy represented by the symbol U and measured in Joules.

When a charged capacitor, $U=CV^2/2$, is connected to an inductor, an electric current flows from the capacitor through the inductor creating a magnetic field, $U=L1^2/2$. When the electric field in the capacitor is exhausted, the current stops and the magnetic field collapses. As the magnetic field collapses, it induces a current to flow in the inductor in the opposite direction to the original current. This new current charges the capacitor thereby creating a new electric field—equal but opposite to the original field. As long as the inductor and capacitor are connected, the energy in the system will oscillate between the magnetic field and the electric field as the current constantly reverses.

The rate—symbol v and measured in Hertz—at which the system oscillates is given by the (square root of l/LC)/2 pi. In practice, the oscillation eventually dampens out due to resistive losses in the conductors and the excess energy is dissipated as heat.

In the Tesla coil 24, the two inductors share the same axis and are located close to one another. In this manner, the magnetic field produced by one inductor generates a current in the other.

The primary oscillator comprises a flat spiral inductor with only a few turns, a capacitor, a voltage source to charge the capacitor, and a switch to connect the capacitor to the inductor. The secondary oscillator contains a large, tightly wound inductor with many turns and a capacitor formed by the earth on one end—the base—and an output terminal—toroid—on the other.

While the switch is open, a low current—limited by the source—flows through the primary inductor, charging the capacitor. When the switch is closed, a much higher current flows from the capacitor through the primary inductor. The resulting magnetic field induces a corresponding current in the secondary. Because the secondary contains many more turns than the primary, a very high electric field is established in the secondary capacitor.

The Tesla coil 24 can be frequency tuned by alternating the pulse width by using MOSFET drivers as a switch, thereby allowing for control of the pulse rate and thus replicating tetanizing frequency.

The output 25 of the Tesla coil 24 is maximized when two conditions are met. First both the primary and secondary oscillate at the same frequency. Secondly the total length of the conductor in the secondary is equal to one quarter of the oscillator's wavelength. A wavelength—symbol X and measured in meters—is equal to the speed of light—300,000,000 meters per second—divided by the frequency of the oscillator.

The spark gap shaping apparatus 22 controls the Tesla coil 24. The first stage directionializer 26 directs the output 25 of the Tesla coil 24. The second stage directionalizer 28 directs the output 27 of the first stage directionalizer 26.

The second stage directionalizer 28 converges—to a converging point 29—multiple laser beams, microwave beams, or even focused UV light—just ahead of the plasma field created by the first stage directionalizer 26.

The converging point 29—at which the beams meet—ionizes just that point of air without ionizing the beam. Once the converging point 29 is arced to by the spark, a second converging point 31, a third converging point 33, and so on is successively formed Just ahead of the newly established shaped plasma field—the beams ionize Just a point and then move that point Just ahead of the spark maintaining the ionization of the trail. This plasma field then goes from being shaped like a sphere to being shaped like a cone—and then ultimately to being shaped like a spike. This spike allows for the tuned energy to be directed at a target at great distances.

The trail is limited only by the ionization potential of the plasma field created by the Tesla coil 24. This effect conceivably has a longer range with higher power inputs—potentially 20 to 50 times the spark range of just the first stage directionalizer 26 alone. For example, if the Tesla coil 24 has a spark of 5 feet, then use of the first stage directionalizer 26 and the second stage directionalizer 28 could extend that range to between 100 and 250 feet.

Figure 3:
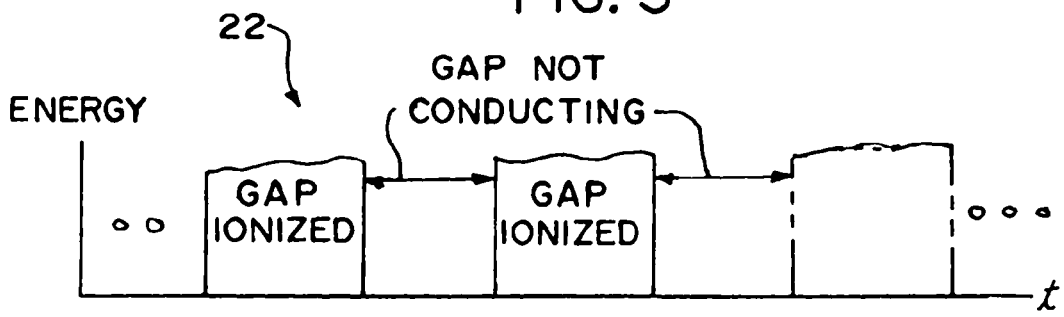
FIG. 3 is an energy v. time diagram of the output of the spark gap shaping apparatus of the tunable and aimable artificial lightening producing device of the present invention enclosed by the dotted curve identified by ARROW 3 in FIG. 2.
Figure 4:
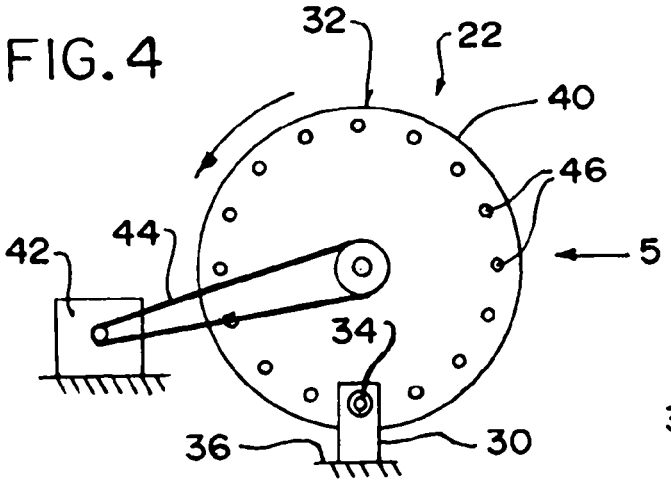
FIG. 4 is a diagrammatic front elevational view of a mechanical embodiment of the spark gap shaping apparatus of the tunable and aimable artificial lightening producing device of the present invention enclosed by the dotted curve identified by ARROW 4 in FIG. 2.
Figure 5:
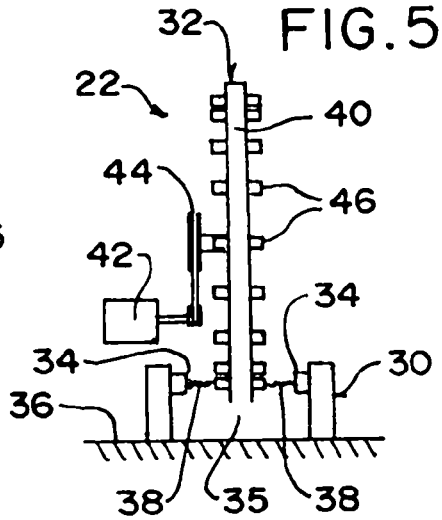
FIG. 5 is a diagrammatic side elevational view taken generally in the direction of ARROW 5 in FIG. 4.

The specific configuration of the spark gap shaping apparatus 22 can best be seen in FIGS. 3-5, which are, respectively, an energy v. time diagram of the output of the spark gap shaping apparatus of the tunable and aimable artificial lightening producing device of the present invention enclosed by the dotted curve identified by ARROW 3 in FIG. 2, a diagrammatic front elevational view of a mechanical embodiment of the spark gap shaping apparatus of the tunable and aimable artificial lightening producing device of the present invention enclosed by the dotted curve identified by ARROW 4 in FIG. 2, and, a diagrammatic side elevational view taken generally in the direction of ARROW 5 in FIG. 4, and as such, will be discussed with reference thereto.

As shown in FIG. 3, the spark gap shaping apparatus 22 provides alternating gap ionization and de-ionization to control the Tesla coil 24.

In an electrical version of the spark gap shaping apparatus 22, the primary circuit is known as a tank circuit that controls pulse width and length. In its simplest form, the spark gap shaping apparatus 22 has two conductors separated by an air gap.

When the electric field stored in the capacitor of the tank circuit reaches a level sufficient to ionize the air within the gap, highly conductive plasma is formed effectively closing the spark gap shaping apparatus 22.

Spark gap switched coils of the tank circuit operate with inputs of approximately 50,000 volts and produce outputs of several million volts. For the spark gap to be effective, it must be able to open rapidly after the primary oscillation has dampened out in order that the capacitor may recharge. This is achieved by several, methods—all of which amount to ways of cooling and dissipating the hot plasma formed during conduction.

The output spark of the spark gap shaping apparatus 22 is the result of the creation and collapse of the output plasma field created when resonance is reached—calibrated for the correct capacitance and induction.

The spark gap shaping apparatus 22 switches up to 150,000 watts of input power. Forced air-cooling of the gap and/or using a number of gaps in series increases power handling. The higher power levels of the tunable and aimable artificial lightening producing device 20 require a rotary gap that mechanically moves gap electrodes rapidly into and out of conduction range.

As shown in FIGS. 4 and 5, in a mechanical version of the spark gap shaping apparatus 22, the spark gap shaping apparatus 22 comprises a stationary spark gap assembly 30 and a rotational conductor 32.

The stationary spark gap assembly 30 of the spark gap shaping apparatus 22 comprises a pair of electrodes 34. The pair of electrodes 34 of the stationary spark gap assembly 30 of the spark gap shaping apparatus 22 are spaced-apart from each other so as to form a gap 35 there between, are supported on a surface 36, and conduct a spark 38 there between to the Tesla coil 24.

The rotational conductor 32 of the spark gap shaping apparatus 22 comprises a wheel 40. The wheel 40 of the rotational conductor 32 of the spark gap shaping apparatus 22 is rotatably mounted at a speed of 1200-1800 rpms in the gap 35 between, and spaced-apart from, the pair of electrodes 14 of the stationary spark gap assembly 30 of the spark gap shaping apparatus 22.

The diameter of the wheel 40 of the rotational conductor 32 of the spark gap shaping apparatus 22 can be changed for changing pulse rate.

The wheel 40 of the rotational conductor 32 of the spark gap shaping apparatus 22 is rotated by a motor 42. The motor 42 of the rotational conductor 32 of the spark gap shaping apparatus 22 is preferably AC, and is connected to the wheel 40 of the rotational conductor 32 of the spark gap shaping apparatus 22 by a pulley and belt system 44.

The wheel 40 of the rotational conductor 32 of the spark gap shaping apparatus 22 has a plurality of pegs 46. The plurality of pegs 46 of the wheel 40 of the rotational conductor 32 of the spark gap shaping apparatus 22 extend there through and there around, and are electrically conductive so as to make the gap 35 between the pair of electrodes 34 of the stationary spark gap assembly 30 of the spark gap shaping apparatus 22 electrically conductive when a peg 46 of the wheel 40 of the rotational conductor 32 of the spark gap shaping apparatus 22 aligns with the pair of electrodes 34 of the stationary spark gap assembly 30 of the spark gap shaping apparatus 22.

The plurality of pegs 46 of the wheel 40 of the rotational conductor 32 of the spark gap shaping apparatus 22 are adjustable—they can be increased or decreased in number and/or positioned changed—for changing pulse rate.

A standard untuned frequency of a Tesla coil exceeds 50,000 Hz. By spinning the rotary spark gap at around 1500 RPM, a 25:1 reduction takes place creating a pulse at 1/20 the rate of the standard frequency—thereby bringing what is perceived to the targeted muscle group as a tetanizing frequency and pulse shape. The frequency at which muscle is tetanized—neuromuscularly disrupted—ranges from 1700 to 2500 Hertz.

To adjust pulse rate, a manual adjustment of either the pulley and belt system 44 of the rotational conductor 32 of the spark gap shaping apparatus 22 or an adjustment of the speed of the motor 42 of the rotational conductor 32 of the spark gap shaping apparatus 22 is required.

Figure 6:
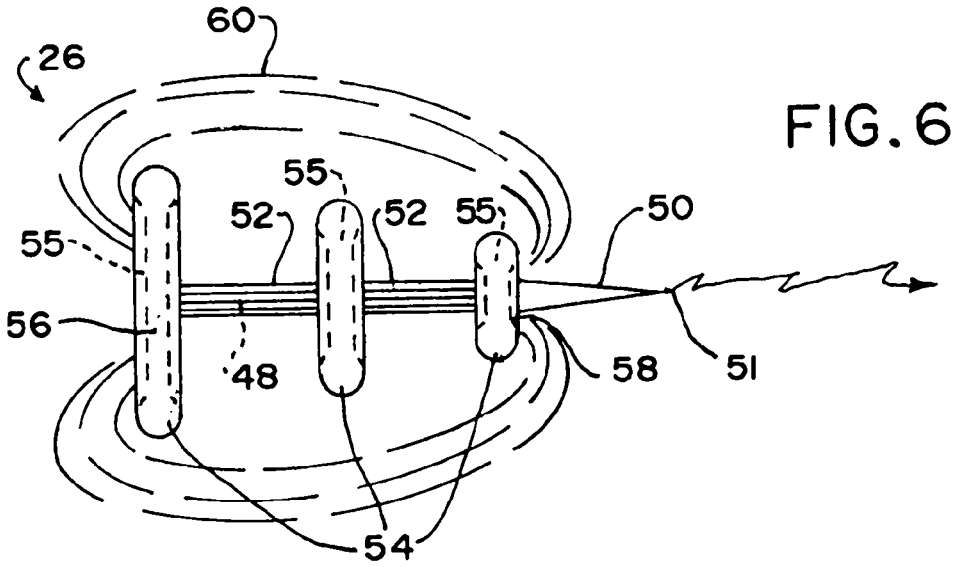
FIG. 6 is an enlarged diagrammatic side elevational view of the area generally enclosed by the dotted curve identified by ARROW 6 in FIG. 2 of the first stage directionalizer of the tunable and aimable artificial lightening producing device of the present invention.

The specific configuration of the first stage directionalizer 26 can best be seen in FIG. 6, which is an enlarged diagrammatic side elevational view of the area generally enclosed by the dotted curve identified by ARROW 6 in FIG. 2 of the first stage directionalizer of the tunable and aimable artificial lightening producing device of the present invention, and as such, will be discussed with reference thereto.

The first stage directionalizer 26 comprises a shaft 48 terminating in an emitter spike 50 having an output 51, at least one wire mesh cage 52, and a plurality of torus-shaped discs 54.

The emitter spike 50 of the shaft 48 of the first stage directionalizer 26 is preferably made of brass, and is retractable and extendably movably mounted to optimize directionality.

The plurality of torus-shaped discs 54 of the first stage directionalizer 26 are preferably made of heavy hollow aluminum or steel, are parallel to each other, are spaced-apart from each other, have hollow centers 55, are stacked perpendicularly to the secondary coil of the Tesla coil 24, and progressively decrease in diameter from a large proximal torus-shaped disc 56 to a small distal torus-shaped disc 58—that is furthest away from the Tesla coil 24.

The shaft 48 of the first stage directionalizer 26 is preferably made of hollow threaded steel, and passes centrally through—so as to connect to each other—the plurality of torus-shaped discs 54 of the first stage directionalizer 26, from the large proximal torus-shaped disc 56 of the first stage directionalizer 26—where it electrically communicates with the output 25 of the Tesla coil 24—to the small distal torus-shaped disc 58 of the first stage directionalizer 26—where it becomes the emitter spike 50.

The at least one wire mesh cage 52 of the first stage directionalizer 26 is preferably heavy gauge, can be replaced by support rods, surrounds the shaft 48 of the first stage directionalizer 26, between adjacent torus-shaped discs 54 of the first stage directionalizer 26, from the large proximal torus-shaped disc 56 of the first stage directionalizer 26 to the small distal torus-shaped disc 58 of the first stage directionalizer 26.

The first stage directionalizer 26 warps the normally spherical plasma field into the shape of a "football" so as to form a warped oval-shaped plasma field 60. The warped oval-shaped plasma field 60 of the first stage directionalizer 26 forces the output 51 of the emitter spike 50 of the shaft 48 of the first stage directionalizer 26 to be pressed from all sides into a column.

The warped oval-shaped plasma field 60 of the first stage directionalizer 26 is established and collapsed at a rate of between 20,000 and 50,000 times a second—meaning that although a long, seemingly single spark is visible to the naked eye, in fact as many as 50,000 individual sparks are being created every second.

The rate of collapse of the warped oval-shaped plasma field 60 of the first stage directionalizer 26 can be regulated through an output switch and sent to, and distributed among, multiple detached emitter spikes 50 of the shaft 48 of the first stage directionalizer 26.

For example, if five emitter spikes 50 of the shaft 48 of the first stage directionalizer 26 are attached to a single Tesla coil 24 firing at 50,000 sparks per second, each emitter spike 50 of the shaft 48 of the first stage directionalizer 26 would be able to fire 10,000 sparks per second—which would be undetectable to the human eye and would not detract from the effectiveness of the tunable and aimable artificial lightening producing device 20 on its target or in its intimidation effect.

Essentially, the first stage directionalizer 26 allows the normally spherical plasma field to create a static charge around the plurality of torus-shaped discs 54 of the first stage directionalizer 26, and then discharge off the emitter spike 50 of the shaft 48 of the first stage directionalizer 26.

The plurality of torus-shaped discs 54 of the first stage directionalizer 26 force the plasma field created by the Tesla coil 24 to become more conically shaped and the emitter spike 50 of the shaft 48 of the first stage directionalizer 26 puts the "point" on the cone—allowing for all the tuned lightning to be fired at a specific target at closer range.

Figure 7:
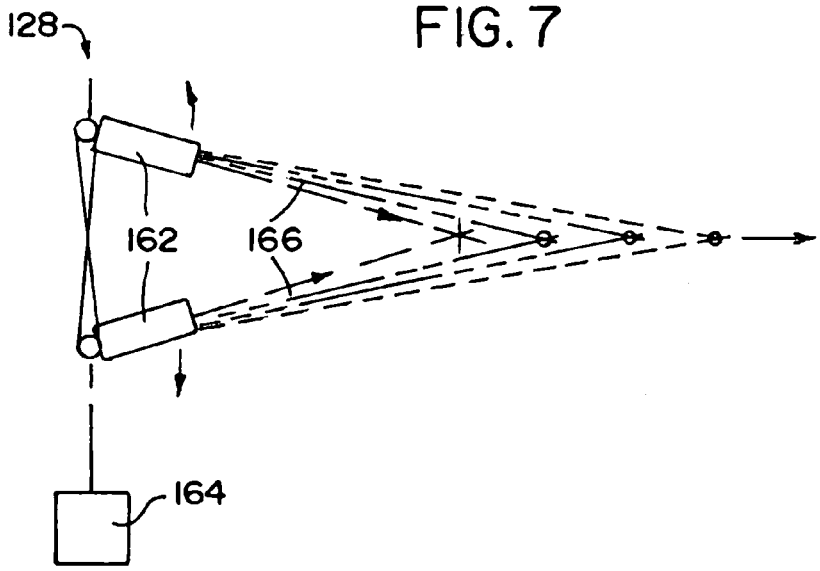
FIG. 7 is a diagrammatic side elevational view of the area generally enclosed by the dotted curve identified by ARROW 7 in FIG. 2 of a first embodiment of the second stage directionalizer of the tunable and aimable artificial lightening producing device of the present invention.

A first embodiment of a second stage directionalizer 128 can best be seen in FIG. 7, which is a diagrammatic side elevational view of the area generally enclosed by the dotted curve identified by ARROW 7 in FIG. 2 of a first embodiment of the second stage directionalizer of the tunable and aimable artificial lightening producing device of the present invention, and as such, will be discussed with reference thereto.

The second stage directionalizer 128 comprises a plurality of lasers 162.

The plurality of lasers 162 of the second stage directionalizer 128 are operatively connected to each other and to a controller 164.

The controller 164 of the second stage directionalizer 128 causes the plurality of lasers 162 of the second stage directionalizer 128 to pivot in concert to cause convergence of beams 166 generated by the plurality of lasers 162 of the second stage directionalizer 128.

Figure 8:
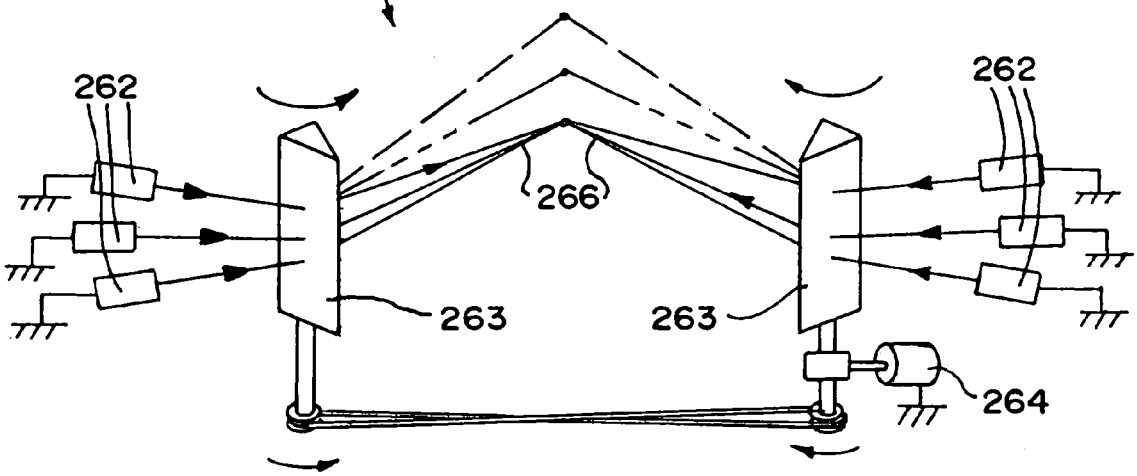
FIG. 8 is a diagrammatic side elevational view of the area generally enclosed by the dotted curve identified by ARROW 8 in FIG. 2 of a second embodiment of the second stage directionalizer of the tunable and aimable artificial lightening producing device of the present invention.

The second embodiment of the second stage directionalizer 228 can best be seen in FIG. 8, which is a diagrammatic side elevational view of the area generally enclosed by the dotted curve identified by ARROW 8 in FIG. 2 of a second embodiment of the second stage directionalizer of the tunable and aimable artificial lightening producing device of the present invention, and as such, will be discussed with reference thereto.

A second stage directionalizer 228 comprises a plurality of lasers 262 and a plurality of prisms 263.

The plurality of prisms 263 of the second stage directionalizer 228 are operatively connected to each other and to a controller 264.

The controller 264 of the second stage directionalizer 228 causes the plurality of prisms 263 of the second stage directionalizer 128 to pivot in concert and cause convergence of beams 266 generated by the plurality of lasers 262 of the second stage directionalizer 228.

Figure 9:
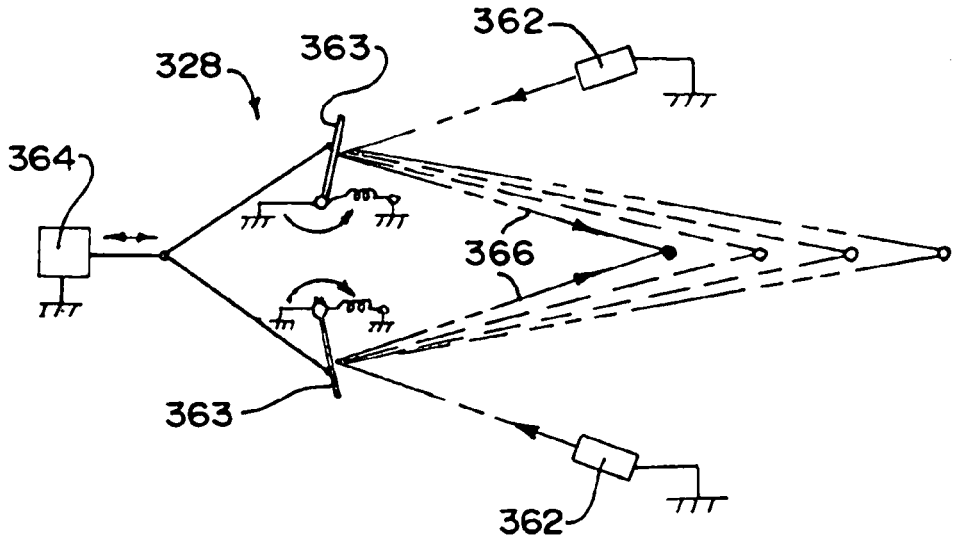
FIG. 9 is a diagrammatic side elevational view of the area generally enclosed by the dotted curve identified by ARROW 9 in FIG. 2 of a third embodiment of the second stage directionalizer of the tunable and aimable artificial lightening producing device of the present invention.

A third embodiment of a second stage directionalizer 328 can best be seen in FIG. 9, which is a diagrammatic side elevational view of the area generally enclosed by the dotted curve identified by ARROW 9 in FIG. 2 of a third embodiment of the second stage directionalizer of the tunable and aimable artificial lightening producing device of the present invention, and as such, will be discussed with reference thereto.

The second stage directionalizer 328 comprises a plurality of lasers 362 and a plurality of mirrors 363.

The plurality of mirrors 363 of the second stage directionalizer 328 are operatively connected to each other and to a controller 364.

The controller 364 of the second stage directionalizer 328 causes the plurality of mirrors 363 of the second stage directionalizer 328 to pivot in concert and cause convergence of beams 366 generated by the plurality of lasers 362 of the second stage directionalizer 328.

Figure 10:
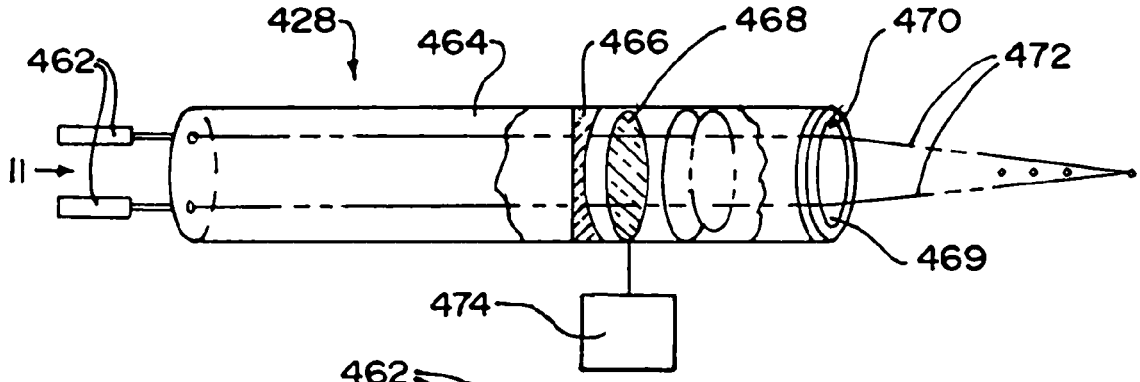
FIG. 10 is a diagrammatic side elevational view, partly in perspective, broken away and in section, of the area generally enclosed by the dotted curve identified by ARROW 10 in FIG. 2 of a fourth embodiment of the second stage directionalizer of the tunable and aimable artificial lightening producing device of the present invention.
Figure 11:
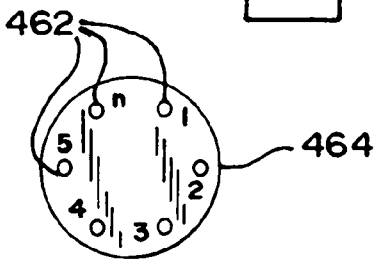
FIG. 11 is an enlarged diagrammatic end elevational view taken generally in the direction of ARROW 11 in FIG. 10.

A fourth embodiment of a second stage directionalizer 428 can best be seen in FIGS. 10 and 11, which are, respectively, a diagrammatic side elevational view partly in perspective, broken away and in section of the area generally enclosed by the dotted curve identified by ARROW 10 in FIG. 2 of a fourth embodiment of the second stage directionalizer of the tunable and aimable artificial lightening producing device of the present invention, and, an enlarged diagrammatic end elevational view taken generally in the direction of ARROW 11 in FIG. 10, and as such, will be discussed with reference thereto.

The second stage directionalizer 428 comprises a plurality of lasers 462, an open-ended tube 464, a fixed concave lens 466, a movable convex lens 468, and a focal lens 469.

The fixed concave lens 466 of the second stage directionalizer 428 is fixed within the open-ended tube 464 of the second stage directionalizer 428, in proximity to a beaming end 470 thereof, at which the focal lens 469 of the second stage directionalizer 428 is disposed.

The movable convex lens 468 of the second stage directionalizer 428 is movably disposed within the open-ended tube 464 of the second stage directionalizer 428, adjacent to, and in optical communication with, the fixed concave lens 466 of the second stage directionalizer 428.

The plurality of lasers 462 of the second stage directionalizer 428 are disposed outside the other end of the open-ended tube 464 of the second stage directionalizer 428, and direct beams 472 through the open-ended tube 464 of the second stage directionalizer 428, to and through the fixed concave lens 466 of the second stage directionalizer 428, to and through the movable convex lens 468 of the second stage directionalizer 428, whose movement is controlled by a controller 474, and to and through the focal lens 469 of the second stage directionalizer 428.

The fixed concave lens 466 of the second stage directionalizer 428 and the movable convex lens 468 of the second stage directionalizer 428 are close coupled to each other to create a collimator lens assembly. The beams 472 of the plurality of lasers 462 of the second stage directionalizer 428 are columnated and passed through the focal lens 469 of the second stage directionalizer 428 that tightens the beams 472 of the plurality of lasers 462 of the second stage directionalizer 428 to a point.

The beams 472 of the plurality of lasers 462 of the second stage directionalizer 428 are compressed into a single beam that is focused onto a single point and then moved—by changing focal length—into the distance by way of the movable convex lens 468 of the second stage directionalizer 428.

It will be understood that each of the elements described above, or two or more together, may also find a useful application in other types of constructions differing from the types described above.

While the invention has been illustrated and described as embodied in a tunable and aimable artificial lightening producing device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An apparatus comprising:

a spark gap shaping apparatus;

a resonance transformer comprising a primary coil electromagnetically coupled to a secondary coil, said resonance transformer coupled to said spark gap shaping apparatus, and said resonance transformer having an output;

an emitter coupled to the output of said resonance transformer; and a second stage directionalizer comprising a plurality of electromagnetic beam generators each operable to emit an electromagnetic energy beam, wherein the second stage directionalizer is operable to focus the electromagnetic energy beams on a convergence point that can be moved to successive locations to create an ionization path, and wherein each electromagnetic energy beam does not individually ionize the air through which it travels.

2. The apparatus of claim 1, further comprising a first stage directionalizer coupled between the output of said resonance transformer and said emitter, wherein said first stage directionalizer is operable to warp a normally spherical plasma field from said resonance transformer into a substantially oval shaped plasma field.

3. The apparatus of claim 2, wherein said first stage directionalizer comprises a plurality of torus-shaped discs.

4. The apparatus of claim 3, wherein said plurality of torus-shaped discs are spaced apart and are arranged parallel to each other.

5. The apparatus of claim 4, wherein said plurality of torus-shaped discs progressively decrease in diameter from said resonance transformer to said emitter.

6. The apparatus of claim 5, further comprising a hollow shaft passing through said plurality of torus-shaped discs.

7. The apparatus of claim 2, wherein said first stage directionalizer comprises a wire mesh cage.

8. The apparatus of claim 3, wherein said plurality of torus-shaped discs are made of aluminum.

9. The apparatus of claim 1, further comprising at least one MOSFET drive operable to be used as a switch to alternate the pulse width to frequency tune said resonance transformer, thereby allowing control of the pulse rate.

10. The apparatus of claim 9, wherein the pulse rate replicates a tentanizing frequency.

11. The apparatus of claim 2, wherein said warped plasma field of said first stage directionalizer is established and collapsed at a rate between 20,000 and 50,000 times a second.

12. The apparatus of claim 11, further comprising an output switch and multiple detached emitters, wherein said rate of collapse of said warped plasma field of said first stage directionalizer is regulated through said output switch and is sent to, and distributed among, the multiple detached emitters.

13. The apparatus of claim 1, wherein said plurality of electromagnetic beam generators are selected from the group consisting of: lasers, microwave generators, and focused UV light generators.

14. The apparatus of claim 1, wherein said plurality of electromagnetic beam generators are lasers.

15. The apparatus of claim 1, further comprising a controller operatively connected to said plurality of electromagnetic beam generators.

16. The apparatus of claim 15, further comprising a means to target said plurality of electromagnetic beams to successive locations, said means operatively connected to said controller and wherein said controller is operable to target said plurality of electromagnetic beams in concert to cause convergence of said plurality of electromagnetic beams.

17. The apparatus of claim 16, wherein said means is selected from the group consisting of: a plurality of prisms, a plurality of mirrors, and a tube containing a fixed concave lens, a movable convex lens and a focal lens.

18. The apparatus of claim 1, wherein said resonance transformer is a Tesla Coil.

19. The apparatus of claim 1, wherein the output of said resonance transformer is in excess of one million volts of electrical potential.

20. A method of projecting lightening comprising the steps of:

a) providing an artificial lightening producing device comprising: a spark shaping apparatus, a resonance transformer comprising a primary coil electromagnetically coupled to a secondary coil coupled to the spark shaping apparatus, an emitter coupled to the secondary coil of the resonance transformer, and a second stage directionalizer comprising a plurality of electromagnetic beam generators operable to ionize air in unison but not individually;

b) generating a electric potential in the emitter with the resonance transformer;

c) with the plurality of electromagnetic beam generators, ionizing the air at a converging point proximate to the emitter;

d) moving the converging point progressively from a point proximate to the emitter to a point proximate to a target, creating a path of ionized air; and e) discharging the electric potential to the target through the path of ionized air.

21. The method of claim 20, further comprising the step of:

f) tuning the frequency of the resonance transformer to replicate a tentanizing frequency.

22. The method of claim 20, further comprising the step of:

g) selecting the plurality of electromagnetic beam generators from the group consisting of: lasers, microwave generators, and focused UV light generators.

* * * * *